US011311100B1

(12) United States Patent
Xia

(10) Patent No.: US 11,311,100 B1
(45) Date of Patent: Apr. 26, 2022

(54) DOUBLE-LAYER FOLDABLE LIFTING DESK WITH LEVER TYPE UNLOCKING STRUCTURE

(71) Applicant: NINGBO SHARESUN ELECTRONIC TECHNOLOGY CO., LTD., Zhejiang (CN)

(72) Inventor: Yongming Xia, Zhejiang (CN)

(73) Assignee: Ningbo Sharesun Electronic Technology Co., Ltd., Ningbo (CN)

( * ) Notice: Subject to any disclaimer, the term of this patent is extended or adjusted under 35 U.S.C. 154(b) by 0 days.

(21) Appl. No.: 17/460,193

(22) Filed: Aug. 28, 2021

(51) Int. Cl.

| | |
|---|---|
| ***A47B 3/02*** | (2006.01) |
| ***A47B 3/00*** | (2006.01) |
| ***A47B 13/02*** | (2006.01) |
| ***E05B 65/44*** | (2006.01) |
| *A47B 21/00* | (2006.01) |

(52) U.S. Cl.
CPC ..... *A47B 3/002* (2013.01); *A47B 13/02* (2013.01); *E05B 65/44* (2013.01); *A47B 21/00* (2013.01); *A47B 2003/006* (2013.01); *A47B 2200/0064* (2013.01)

(58) Field of Classification Search
CPC . A47B 13/02; A47B 21/00; A47B 2200/0064; A47B 3/002; A47B 9/16; E05B 65/44
See application file for complete search history.

(56) References Cited

U.S. PATENT DOCUMENTS

| | | | | |
|---|---|---|---|---|
| 10,092,089 | B1 * | 10/2018 | Yuan | A47B 3/002 |
| 10,258,148 | B1 * | 4/2019 | Donner | A47B 9/18 |
| 11,083,282 | B1 * | 8/2021 | Liu | A47B 21/02 |
| 2015/0250303 | A1 * | 9/2015 | Flaherty | A47B 21/02 108/50.02 |

(Continued)

FOREIGN PATENT DOCUMENTS

| | | | |
|---|---|---|---|
| CN | 107495618 | A * | 12/2017 |
| CN | 107510234 | A * | 12/2017 |

*Primary Examiner* — Matthew W Ing
(74) *Attorney, Agent, or Firm* — Jingfeng Song; SciNova IP and Regulatory Consulting LLC

(57) ABSTRACT

The present invention discloses a double-layer foldable lifting desk with a lever-type unlocking structure and relates to the technical field of foldable lifting desks. The double-layer foldable lifting desk with the lever type unlocking structure includes a desktop board, wherein a lower side of the desktop board is connected to an X-shaped lifting frame, a lower end of which is connected to a bottom frame; a limiting shaft is arranged at one end of an upper side of the X-shaped lifting frame; one side of the bottom of the desktop board is connected through a bolt to a guide rail, which is slidingly connected to two ends of the limiting shaft; and an unlocking mechanism corresponding to the limiting shaft is arranged on a lower side of one end of the desktop board. The present invention has the following beneficial effects: the unlocking structure is arranged on the lower side of the desktop board so that the use space of the desktop side is not occupied; a lever principle is used to make an unlocking lever rotate, and the reasonable and simple structure is not (Continued)

liable to get stuck, thereby avoiding the inconvenience caused by the unlocking structure of the traditional lifting desk that occupies the area of the desktop board.

8 Claims, 7 Drawing Sheets

(56) References Cited

U.S. PATENT DOCUMENTS

| | | | | |
|---|---|---|---|---|
| 2016/0120300 | A1* | 5/2016 | Ergun | A47B 9/16 108/106 |
| 2016/0249737 | A1* | 9/2016 | Han | A47B 9/14 108/145 |
| 2017/0105518 | A1* | 4/2017 | Huang | A47B 21/02 |
| 2017/0354245 | A1* | 12/2017 | Martin | A47B 21/02 |
| 2018/0125227 | A1* | 5/2018 | Xiang | A47B 21/02 |
| 2020/0029685 | A1* | 1/2020 | Du | A47B 21/02 |

* cited by examiner

DOUBLE-LAYER FOLDABLE LIFTING DESK WITH LEVER TYPE UNLOCKING STRUCTURE

TECHNICAL FIELD

The present invention relates to the technical field of foldable lifting desks, and more particularly, to a double-layer foldable lifting desk with a lever type unlocking structure.

BACKGROUND

With the progress of society and times and the development of science and technology, people use a wide range of tools and equipment in their daily lives and facilitate their lives by them. Currently, the foldable lifting desk is a commonly used desktop product, and is a bearing tool for placing articles on the desktop and performing lifting operation. At the same time, the foldable lifting desk has the following advantages: a small occupied space, strong adjustability, and high mobility.

When using an existing foldable lifting desk, a sliding plate of an unlocking structure usually passes through a desktop board and appears on the upper surface of the desktop board so that users can prod the sliding plate conveniently. However, this occupies the desktop board that has a relatively small area and brings a lot of inconvenience to the use of the desktop board. Moreover, the existing foldable lifting desk generally has only one layer of desktop, and it is impossible to place a computer and a keyboard on it at the same time. Therefore, its functionality is weak.

SUMMARY

An objective of the present invention is to provide a double-layer foldable lifting desk with a lever type unlocking structure, which solves the problems in the background art that during use of an existing foldable lifting desk, a sliding plate of an unlocking structure generally passes through a desktop board and appears on the upper surface of the desktop board so that users can prod the sliding plate conveniently. However, this structure occupies the desktop board with a relatively small area and brings a lot of inconvenience to the use of the desktop board. Moreover, the existing foldable lifting desk generally has only one layer of desktop. Therefore, it is impossible to place a computer and a keyboard at the same time and the desk's functionality is weak.

To achieve the above objective, the present invention provides the following technical solution: a double-layer foldable lifting desk with a lever type unlocking structure includes a desktop board, wherein a lower side of the desktop board is connected to an X-shaped lifting frame, and a lower end of the X-shaped lifting frame is connected to a bottom frame. A limiting shaft is arranged at one end of an upper side of the X-shaped lifting frame. One side of the bottom of the desktop board is connected to a guide rail through a bolt, and the guide rail is slidingly connected to two ends of the limiting shaft. An unlocking mechanism corresponding to the limiting shaft is arranged on a lower side of one end of the desktop board. The unlocking mechanism includes a supporting plate which is arranged on the lower side of one end of the desktop board. A rotating shaft base is arranged on a middle part of the supporting plate, and an inner side of the rotating shaft base is connected to an unlocking lever through a rotating shaft. An unlocking rotating rod assembly is mounted on the lower side of the desktop board, and the unlocking rotating rod assembly internally includes a limiting rack. The limiting rack is connected to one side of the bottom end of the desktop board. An unlocking rotating rod is arranged on the lower side of the desktop board, and one end of the unlocking rotating rod is rotatably connected to one end of the supporting plate and is in gear engagement with the limiting rack. An inside end of the unlocking lever extends to an end part of the unlocking rotating rod. A connecting late is mounted at the lower end of one side of the desktop board. An auxiliary desk board is connected below the desktop board through the connecting plate.

Preferably, the auxiliary desk board and the desktop board are distributed in parallel, and the section area of the auxiliary desk board is less than that of the desktop board.

Preferably, a protective cover which covers the unlocking rotating rod assembly is mounted on the lower side of the desktop board, and a buckling groove is formed at the edge of the bottom frame.

Preferably, the protective cover and the desktop board form a detachable structure through a bolt, and a horizontal axis of the protective cover coincides with a horizontal axis of the unlocking rotating rod assembly.

Preferably, a bending portion is arranged on an end part of the unlocking rotating rod, an inside end of the unlocking lever extends between the bending portion and the desktop board, the unlocking rotating rod is in sleeving connection with a torsional spring connected to the supporting plate, an auxiliary reset torsional spring is mounted between the unlocking lever and the supporting plate, the rotating shaft in the rotating shaft base is in sleeving connection with a plastic sleeve, one end of the plastic sleeve abuts against the unlocking lever, and a limiting buckling plate vertical to the unlocking lever is arranged at an outside end of the unlocking lever.

Preferably, the unlocking lever and the rotating shaft base form a rotating structure through the rotating shaft, and the unlocking lever and the supporting plate form an elastic structure through the auxiliary reset torsional spring.

Preferably, a gas spring is mounted in the X-shaped lifting frame, and one end of the gas spring is connected to a middle part of the X-shaped lifting frame and the other end of the gas spring is connected to the bottom of the X-shaped lifting frame.

Preferably, two rod bodies of the X-shaped lifting frame form a lifting structure through the gas spring and a shaft body, and the X-shaped lifting frame and the guide rail form a sliding structure through a lifting shaft.

The present invention provides a double-layer foldable lifting desk with a lever type unlocking structure, and has the following beneficial effects: according to the double-layer foldable lifting desk with the lever type unlocking structure, the unlocking structure is arranged on the lower side of the desktop board so that the use space of the desktop side is not occupied; a lever principle is used to make an unlocking rotating lever rotate, the structure is reasonable and simple, and is not liable to get stuck, thereby avoiding the inconvenience caused by that the unlocking structure of the traditional lifting desk occupies the area of the desktop board. Moreover, by arranging the bottom frame and the limiting rack, people will press the lifting desk when using the lifting desk so that the limiting shaft of the X-shaped lifting frame abuts against the inside of the limiting rack, thereby enhancing the use stability of the lifting desk.

Figure 1:
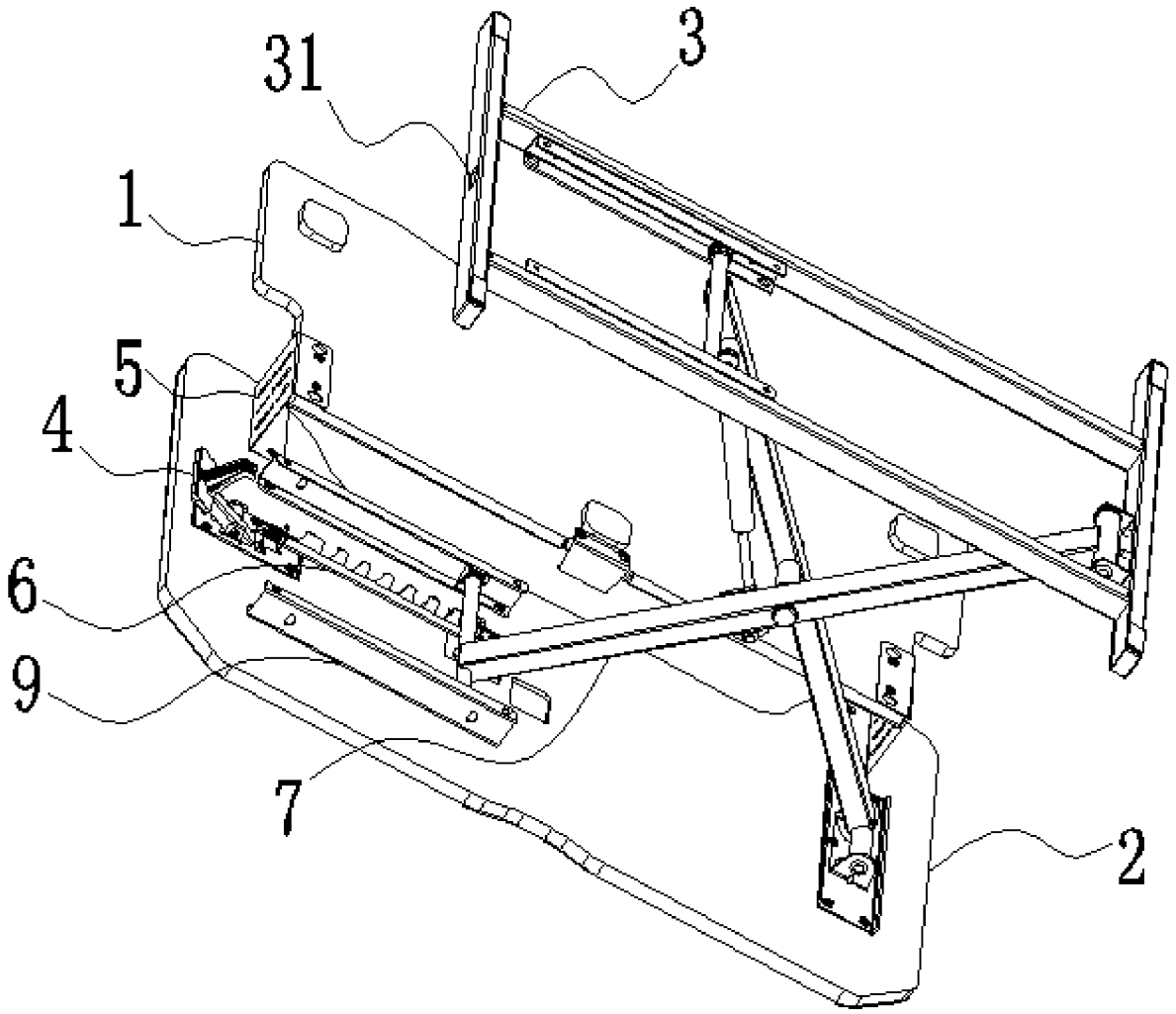
FIG. 1 is a bottom upward view three-dimensional structural schematic diagram of a double-layer foldable lifting desk with a lever type unlocking structure according to the present invention.

In the drawings, 1. Auxiliary desk board; 2. Desktop board; 3. Bottom frame; 31. Buckling groove; 4. Unlocking mechanism; 411. Unlocking rotating rod; 4111. Bending portion; 412. Limiting buckling plate; 413. Torsional spring; 414. Supporting plate; 4141. Rotating shaft base; 415. Unlocking lever. 416. Plastic sleeve; 417. Auxiliary reset torsional spring. 5. Connecting plate; 6. Unlocking rotating rod assembly. 61. Limiting rack. 7. X-shaped lifting frame. 71. Limiting shaft; 8. Gas spring; 9. Guide rail; 10. Protective cover.

DETAILED DESCRIPTION OF EMBODIMENTS

The following clearly and completely describes the technical solutions in the embodiments of the present invention with reference to accompanying drawings in the embodiments of the present invention. Apparently, the described embodiments are merely a part rather than all of the embodiments of the present invention.

In the description of the present invention, unless otherwise specified, "a plurality of" means two or more; the orientation or position relationship indicated by terms "upper", "lower", "left", "right", "inner", "outer", "front end", "rear end", "head", "tail" and the like are the orientation or position relationship as shown in the drawings, and these terms are only intended to facilitate description of the present invention and simplify the description, but not to indicate or imply that the mentioned devices or elements must have a specific orientation and must be established and operated in a specific orientation, and thus, these terms cannot be understood as a limitation to the present invention. Moreover, terms like "first", "second", "third" and the like are only used for description, and cannot be understood as indicating or implying relative importance.

In the description of the present invention, it should be noted that, unless otherwise clearly specified and limited, meanings of terms "connected to", and "connection" should be understood in a board sense. For example, the connection may be a fixed connection, a detachable connection, or an integral connection. In some cases, it may be a mechanical connection or an electrical connection. In other cases, it may be a direct connection or an indirect connection by using an intermediate medium. A person of ordinary skill in the art may understand specific meanings of the foregoing terms in the present invention based on a specific situation.

Figure 2:
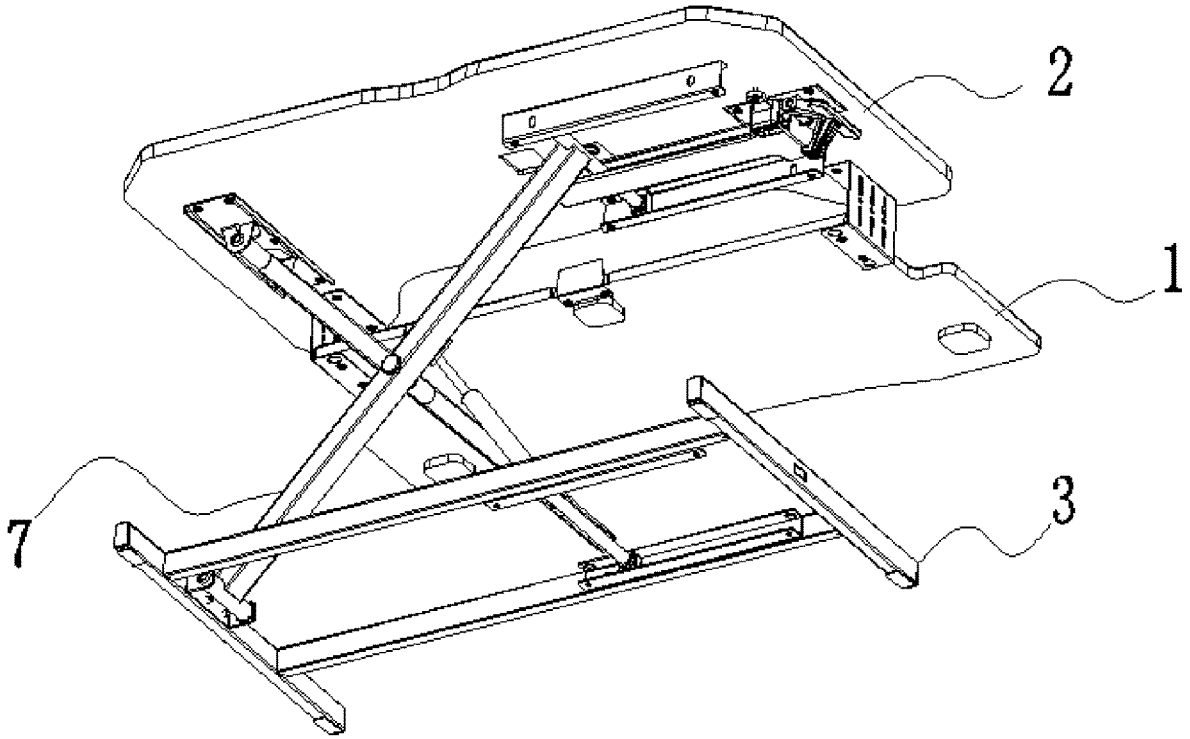
FIG. 2 is a top upward view three-dimensional structural schematic diagram of a double-layer foldable lifting desk with a lever type unlocking structure according to the present invention.
Figure 3:
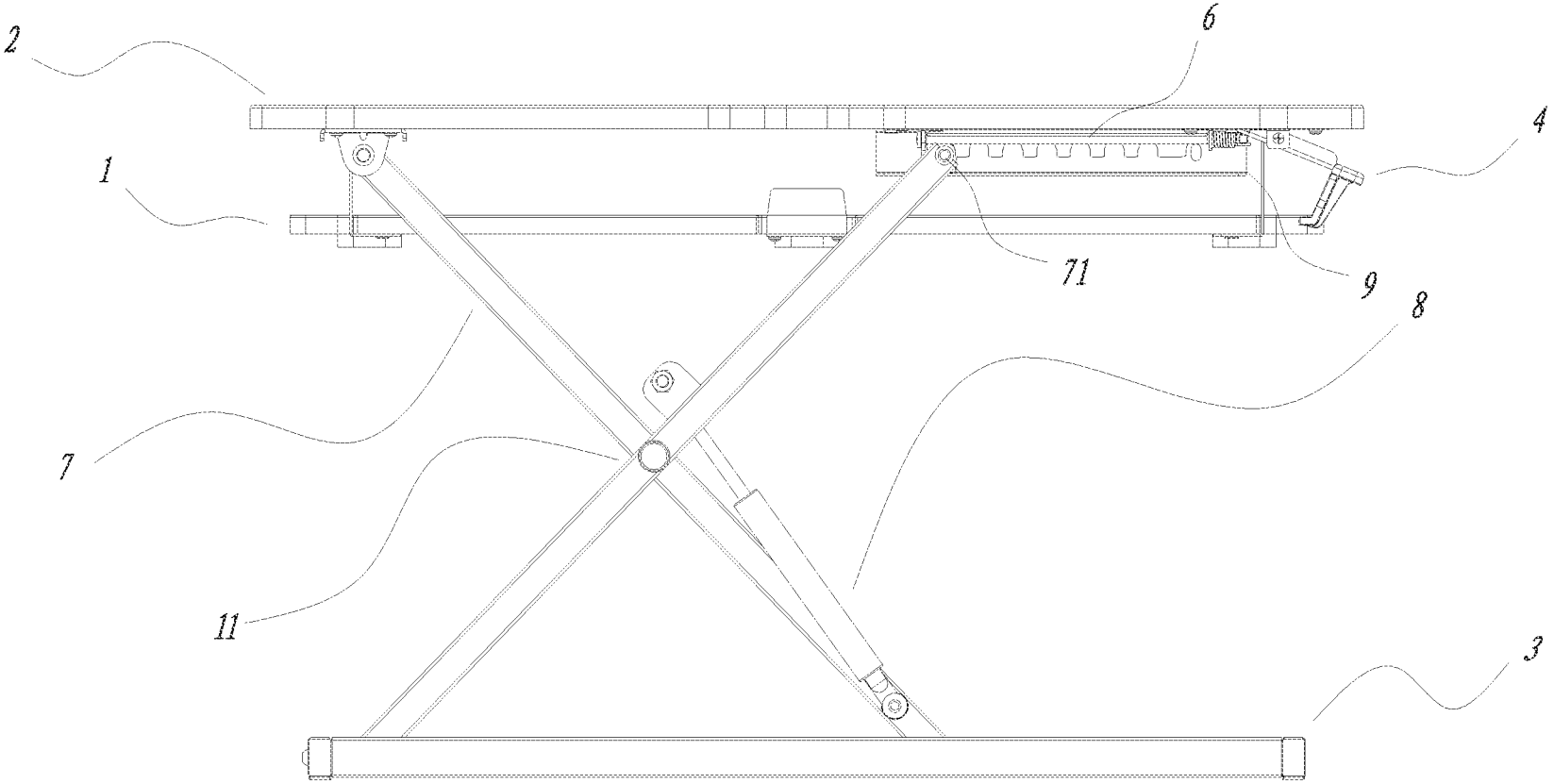
FIG. 3 is a front view structural schematic diagram of a double-layer foldable lifting desk with a lever type unlocking structure according to the present invention.
Figure 4:
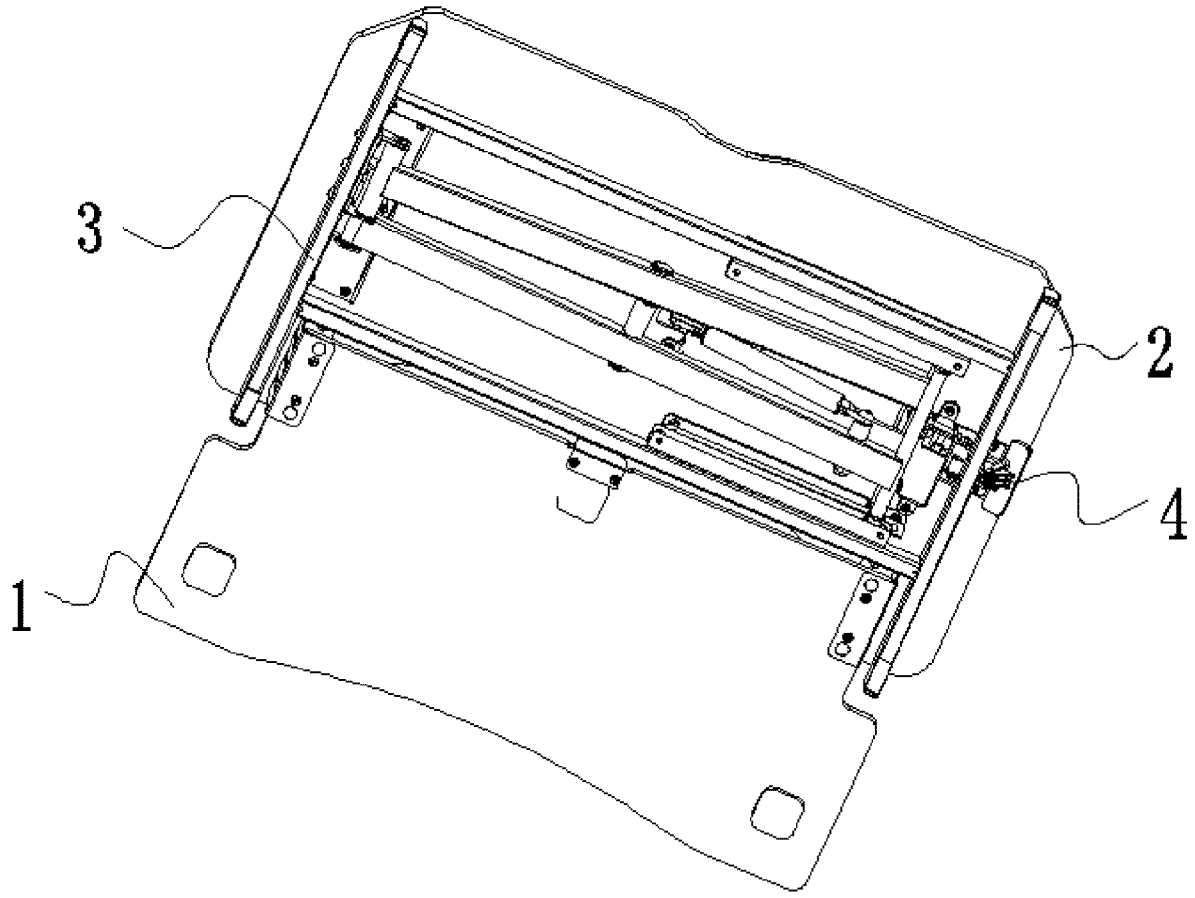
FIG. 4 is a structural schematic diagram of a first folding state of a double-layer foldable lifting desk with a lever type unlocking structure according to the present invention.
Figure 5:
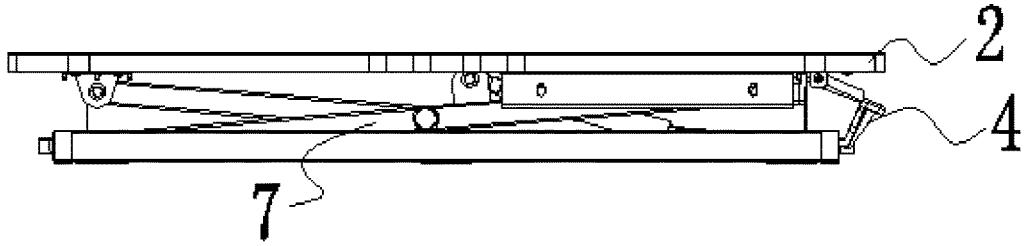
FIG. 5 is a structural schematic diagram of a second folding state of a double-layer foldable lifting desk with a lever type unlocking structure according to the present invention.
Figure 6:
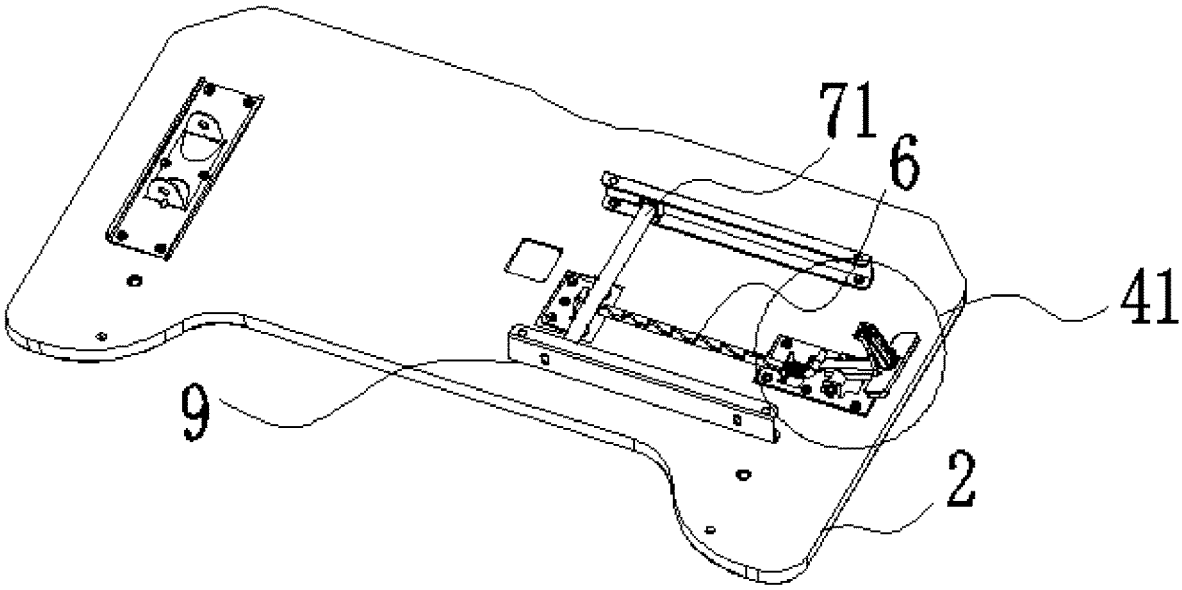
FIG. 6 is a schematic diagram of a bottom structure of a desktop board of a double-layer foldable lifting desk with a lever type unlocking structure according to the present invention.
Figure 7:
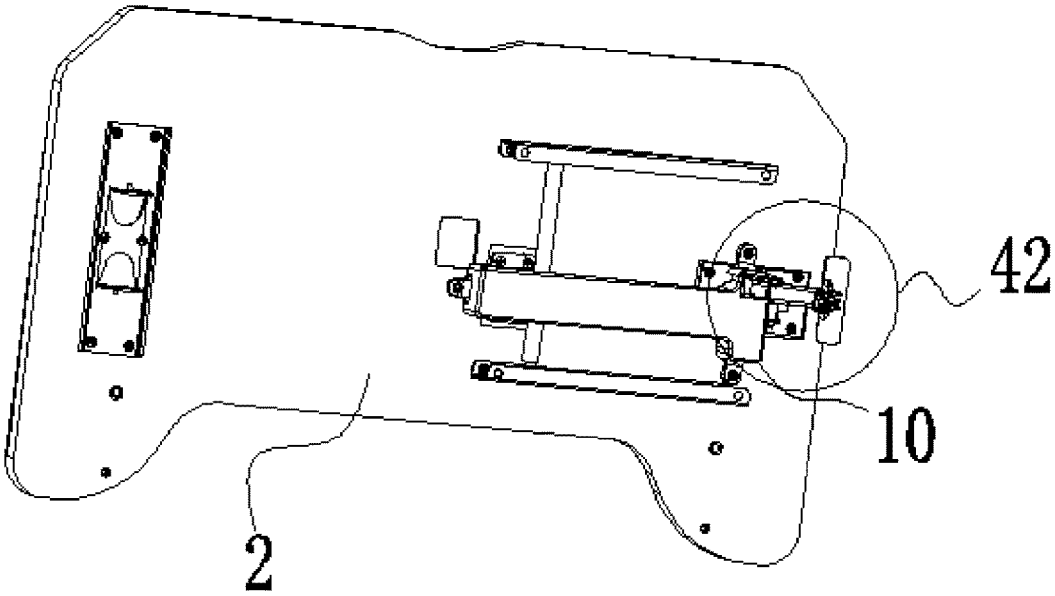
FIG. 7 is a structural schematic diagram of a connecting structure of a protective cover and a desktop board of a double-layer foldable lifting desk with a lever type unlocking structure according to the present invention.
Figure 8:
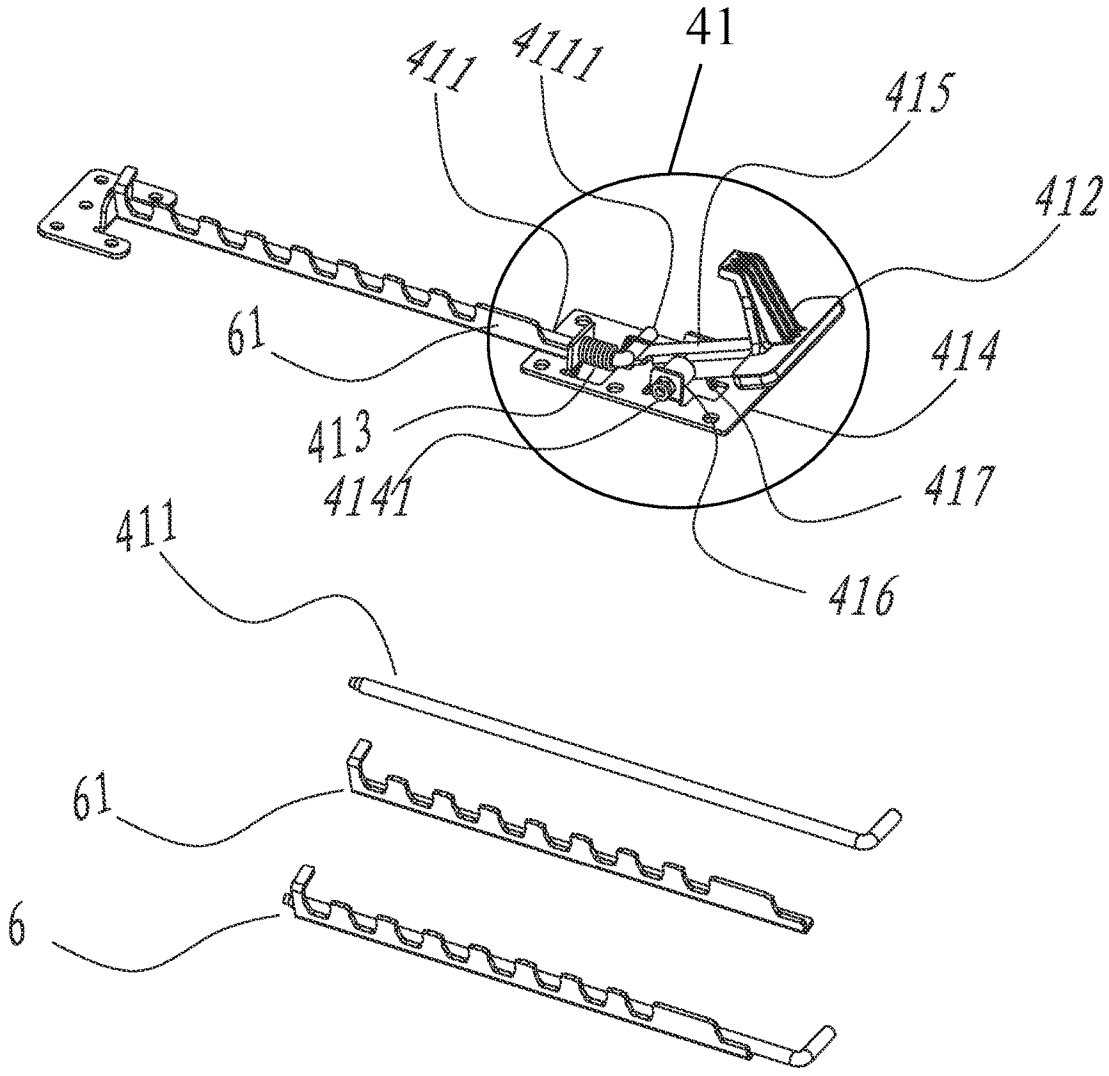
FIG. 8 is an enlarged structural schematic diagram of a position 41 of a double-layer foldable lifting desk with a lever type unlocking structure according to the present invention.
Figure 9:
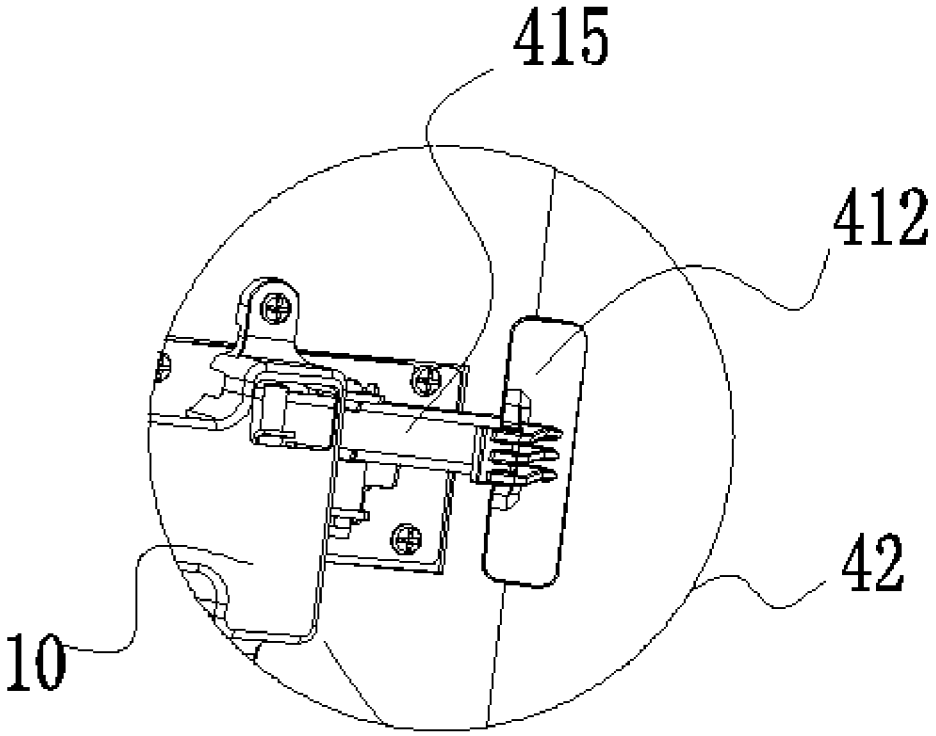
FIG. 9 is an enlarged structural schematic diagram of a position 42 of a double-layer foldable lifting desk with a lever type unlocking structure according to the present invention.

Referring to FIG. 1 to FIG. 9, the present invention provides a technical solution: a double-layer foldable lifting desk with a lever type unlocking structure includes an auxiliary desk board 1, a desktop board 2, a bottom frame 3, a buckling groove 31, an unlocking mechanism 4, an unlocking rotating rod 411, a bending portion 4111, a lifting buckling plate 412, a torsional spring 413, a supporting plate 414, a rotating shaft base 4141, an unlocking lever 415, a plastic sleeve 416, an auxiliary reset torsional spring 417, a connecting plate 5, an unlocking rotating rod assembly 6, a limiting rack 61, an X-shaped lifting frame 7, a limiting shaft 71, a gas spring 8, a guide rail 9 and a protective cover 10, wherein a lower side of the desktop board 2 is connected to the X-shaped lifting frame, and a lower end of the X-shaped lifting frame 7 is connected to the bottom frame 3. The protective cover plate 10 covering the unlocking rotating rod assembly 6 is mounted on a lower side of the desktop board 2 to form a detachable structure, and a horizontal axis of the protective cover 10 coincides with a horizontal axis of the unlocking rotating rod assembly 6. Rotation of the unlocking rotating rod assembly 6 may be protected by the protective cover 10 so as to prevent a user's hand from being clamped by the unlocking rotating rod. The buckling groove 31 is formed at the edge of the bottom frame.

The limiting shaft 71 is arranged at one end of an upper side of the X-shaped lifting frame 7. The gas spring 8 is mounted in the X-shaped lifting frame 7. One end of the gas spring 8 is connected to a middle part of the X-shaped lifting frame 7 and the other end of the gas spring 8 is connected to the bottom of the X-shaped lifting frame 7. The gas spring 8 may drive the X-shaped lifting frame 7 to rotate as ascending power of the lifting desk. Two groups of rod bodies of the X-shaped lifting frame 7 form a lifting structure through the gas spring 8 and a shaft body, and the X-shaped lifting frame 7 and the guide rail 9 form a sliding structure through the limiting shaft 71. The X-shaped lifting frame 7 may be driven by the gas spring 8 to rotate around the shaft body so that the corresponding angle of the X-shaped lifting frame 7 changes to realize lifting.

One side of the bottom of the desktop board 2 is connected to the guide rail 9 through a bolt, and the guide rail 9 is slidingly connected to two ends of the limiting shaft 71. The unlocking mechanism 4 corresponding to the limiting shaft 71 is arranged on a lower side of one end of the desktop board 2. The unlocking mechanism 4 includes the supporting plate 414 mounted on the lower side of one end of the desktop board 2. The rotating shaft base 4141 is arranged on a middle part of the supporting plate 414, and an inner side of the rotating shaft base 4141 is connected to the unlocking lever 415 through a rotating shaft. The unlocking lever 415 and the rotating shaft base 4141 form a rotating structure through the rotating shaft, and the unlocking lever 415 and the supporting plate 414 form an elastic structure through the auxiliary reset torsional spring 417. The auxiliary reset torsional spring 417 can automatically set the unlocking lever. the unlocking rotating rod assembly 6 is mounted on the lower side of the desktop board 2, and the unlocking rotating rod assembly 6 internally includes the limiting rack 61. The limiting rack 61 is connected to one side of the bottom end of the desktop board 2. The unlocking rotating rod 411 is arranged on the lower side of the desktop board 2, and one end of the unlocking rotating rod 411 is rotatably connected to one end of the supporting plate 414 and is in gear engagement with the limiting rack 61. The bending portion 4111 is arranged on an end part of the unlocking rotating rod 411, and an inside end of the unlocking lever 415 extends between the bending portion 4111 and the desktop board 2. The bending portion 4111 is driven by the inside end of the unlocking lever 415 to rotate. The unlocking rotating rod 411 is in sleeving connection with the torsional spring 413 connected to the supporting plate 414. The torsional spring 413 may automatically return the unlocking rotating rod 411. The auxiliary reset torsional spring 417 is mounted between the unlocking lever 415 and the supporting plate 414. The rotating shaft in the rotating shaft base 4141 is in sleeving connection with the plastic sleeve 416. One end of the plastic sleeve 416 abuts against the unlocking lever 415. The plastic sleeve 416 may buffer the rotation of the unlocking lever 415 and ensure stability when the unlocking lever 415 rotates. The limiting buckling plate 412 vertical to the unlocking lever 415 is arranged at an outside end of the unlocking lever 415. The limiting buckling plate 412 is buckled with the buckling groove in the bottom frame 3 when the foldable lifting desk is folded. The inside end of the unlocking lever 415 extends to the end part of the unlocking rotating rod 411. The inside end of the unlocking lever 415 drives the unlocking rotating rod 411 to rotate when the unlocking lever 415 rotates. The unlocking rotating rod 411 may be separated from the limiting shaft 71 during rotation so that the limiting shaft 71 may slide, the X-shaped lifting frame 7 is folded and the desktop board 2 ascends and descends. The connecting plate 5 is mounted at the lower end of one side of the desktop board 2, and the auxiliary desk board 1 is connected below the desktop board 2 through the connecting plate 5. The auxiliary desk board 1 extends to the outer side of the desktop board 2, the auxiliary desk board 1 and the desktop board 2 are distributed in parallel, and the section area of the auxiliary desk board 1 is less than that of the desktop board 2. Through two groups of desk boards, the placing area of the lifting desk for articles is enlarged.

In conclusion, during use of the double-layer foldable lifting desk with the lever type unlocking structure, the lifting desk is moved to a use area by a user, then the limiting buckling plate 412 is manually prodded, and the limiting buckling plate 412 performs relative rotating operation with the rotating shaft base 4141 around the shaft body through the unlocking lever 415. In this way the unlocking rotating rod 411 can be driven to rotate, the unlocking rotating rod 411 may be separated from the limiting shaft 71 during rotation, and the limiting shaft 71 may slide. After the limiting buckling plate 412 is separated from the buckling groove 31 in the bottom frame 3, the gas spring 8 is started to push the X-shaped limiting frame 7, and the X-shaped lifting frame 7 rotates around the shaft body inside to complete lifting operation. When a notebook computer is placed on the desktop board 2, the limiting shaft 71 of the X-shaped lifting frame 7 abuts against the inner side of the limiting rack 61 so that the stability of the lifting desk during use is enhanced, and the articles can be placed through the desktop board 2 and the auxiliary desk board 1.

The foregoing description only provides preferred specific embodiments of the present invention, but the protection scope of the present invention is not limited thereto. Any equivalent replacement or modification made according to the technical solution and inventive concept by a person skilled in the art within the technical scope of the present invention shall fall within the protection scope of the present invention.

What is claimed is:

1. A double-layer foldable lifting desk with a lever type unlocking structure, comprising a desktop board, wherein the bottom side of the desktop board is connected to a single X-shaped lifting frame that consists of two rod bodies, a gas spring, a single rotation shaft, and a limiting shaft, and a lower end of the X-shaped lifting frame is connected to a bottom frame; a limiting shaft is arranged at one end of the upper side of the X-shaped lifting frame; one end of the bottom side of the desktop board is connected to a guide rail through a bolt, and the guide rail is slidingly connected to two ends of the limiting shaft; an unlocking mechanism corresponding to the limiting shaft is arranged on the bottom side of the desktop board; the unlocking mechanism comprises a supporting plate that is arranged on one end of the desktop board's bottom side; a rotating shaft base is arranged on a middle part of the supporting plate, and an inner side of the rotating shaft base is connected to an unlocking lever through a rotating shaft; an unlocking rotating rod assembly is mounted on the bottom side of the desktop board, and the unlocking rotating rod assembly internally comprises a limiting rack having multiple grooves; the limiting rack is connected to one end of the bottom side of the desktop board; an unlocking rotating rod is arranged on the bottom side of the desktop board, and one end of the unlocking rotating rod is rotatably connected to one end of the supporting plate and is in gear engagement with the limiting rack; one end of the unlocking lever extends to the end of the unlocking rotating rod; two connecting plates are mounted at the bottom side of the desktop board; and an auxiliary desk board is connected below the desktop board through the connecting plate.

2. The double-layer foldable lifting desk with the lever type unlocking structure according to claim 1, wherein the auxiliary desk board and the desktop board are distributed in parallel, and the section area of the auxiliary desk board is less than that of the desktop board.

3. The double-layer foldable lifting desk with a lever type unlocking structure according to claim 1, wherein a protective cover which covers the unlocking rotating rod assembly is mounted on the lower side of the desktop board, and a buckling groove is formed at the edge of the bottom frame.

4. The double-layer foldable lifting desk with the lever type unlocking structure according to claim 3, wherein the protective cover and the desktop board form a detachable structure through a bolt, and a horizontal axis of the protective cover coincides with a horizontal axis of the unlocking rotating rod assembly.

5. The double-layer foldable lifting desk with the lever type unlocking structure according to claim 1, wherein a bending portion is arranged on an end part of the unlocking rotating rod, an inside end of the unlocking lever extends between the bending portion and the desktop board, the unlocking rotating rod is in sleeving connection with a torsional spring connected to the supporting plate, an auxiliary reset torsional spring is mounted between the unlocking lever and the supporting plate, the rotating shaft in the rotating shaft base is in sleeving connection with a plastic sleeve, one end of the plastic sleeve abuts against the unlocking lever, and a limiting buckling plate vertical to the unlocking lever is arranged at an outside end of the unlocking lever.

6. The double-layer foldable lifting desk with the lever type unlocking structure according to claim 5, wherein the unlocking lever and the rotating shaft base form a rotating structure through the rotating shaft, and the unlocking lever and the supporting plate form an elastic structure through the auxiliary reset torsional spring.

7. The double-layer foldable lifting desk with the lever type unlocking structure according to claim 1, wherein a gas spring is mounted in the X-shaped lifting frame, and one end of the gas spring is connected to a middle part of the X-shaped lifting frame and the other end of the gas spring is connected to the bottom of the X-shaped lifting frame.

8. The double-layer foldable lifting desk with the lever type unlocking structure according to claim 7, wherein two rod bodies of the X-shaped lifting frame form a lifting structure through the gas spring, and the X-shaped lifting frame forms a sliding structure with the guide rail and a locking structure through the limiting shaft and the limiting rack.

* * * * *